US009156599B2

(12) United States Patent
Gustavsson

(10) Patent No.: US 9,156,599 B2
(45) Date of Patent: Oct. 13, 2015

(54) METHOD OF PRODUCING AN ENFORCED DELIMITED ELEMENT AND SUCH AN ELEMENT

(75) Inventor: Jack Gustavsson, Katrineholm (SE)

(73) Assignee: CESIUM HOLDING AB, Katrineholm (SE)

( * ) Notice: Subject to any disclaimer, the term of this patent is extended or adjusted under 35 U.S.C. 154(b) by 24 days.

(21) Appl. No.: 13/824,752

(22) PCT Filed: Sep. 24, 2011

(86) PCT No.: PCT/SE2011/000166

§ 371 (c)(1),
(2), (4) Date: Jun. 26, 2013

(87) PCT Pub. No.: WO2012/039661

PCT Pub. Date: Mar. 29, 2012

(65) Prior Publication Data

US 2013/0277378 A1 Oct. 24, 2013

(30) Foreign Application Priority Data

Sep. 24, 2010 (SE) ..... 1000954

(51) Int. Cl.
*B65D 81/00* (2006.01)
*E04C 2/34* (2006.01)
*B65D 90/02* (2006.01)

(52) U.S. Cl.
CPC ..... *B65D 81/00* (2013.01); *E04C 2/3405* (2013.01); *B65D 90/022* (2013.01); (Continued)

(58) Field of Classification Search
CPC ..... E04C 2/34; E04C 2/3405; E04C 2/36; E04C 2/543; E04C 2002/3477; E04C 2003/043; E04C 2/22; E04C 2003/0439; E04C 2002/3466; E04C 2002/3455; E04C 2002/3461; E04C 2002/3472; B29C 47/0023; B65D 90/022; B65D 90/028; B32B 3/20; B32B 3/30; E04B 9/064; B29D 24/008
USPC ..... 52/783.1, 790.1, 657, 843, 846, 834, 52/742.1, 745.19; 428/120, 167, 178, 188; 108/51.3, 52.1
See application file for complete search history.

(56) References Cited

U.S. PATENT DOCUMENTS 2,348,703 A * 5/1944 Weir et al. ..... 428/121
2,576,715 A * 11/1951 Farrell ..... 108/51.3
(Continued)

FOREIGN PATENT DOCUMENTS

DE 2 118 108 A1 12/1972
DE 10 2007 035 228 A1 11/2008
(Continued)

OTHER PUBLICATIONS

International Search Report, dated Jan. 10, 2012, from corresponding PCT application.

*Primary Examiner* — Joshua J Michener
*Assistant Examiner* — Babajide Demuren
(74) *Attorney, Agent, or Firm* — Young & Thompson

(57) ABSTRACT

Method of producing an enforced composite surface delimited element such as a wall, ceiling or roof includes: connecting profile elements, preferably of metal and having a length within the interval 200-250 cm, a width within the interval 15-35 cm, and a depth within the interval 18-40 cm, side by side constituting cell modules having passing through cell elements; adding a substance or a material to the modules to bring completing properties to the construction element; and providing the cell modules with an inner and/or outer completely covering layer at the same time adding strength to the surface delimited element. The surface delimited element includes a series of cell modules constituting of profile elements forming intermediate cells, wherein each cell module has a width of at least 30 cm, a depth of at least 18 cm and the cell modules are internally.

15 Claims, 1 Drawing Sheet

(52) U.S. Cl.
CPC ..... *B65D 90/028* (2013.01); *E04C 2002/3455* (2013.01); *E04C 2002/3461* (2013.01); *E04C 2002/3466* (2013.01); *E04C 2002/3472* (2013.01); *E04C 2002/3477* (2013.01)

(56) References Cited

U.S. PATENT DOCUMENTS

| | | | | | |
|---|---|---|---|---|---|
| 3,191,724 | A | * | 6/1965 | De Ridder | 52/570 |
| 3,534,463 | A | * | 10/1970 | Molin et al. | 228/185 |
| 3,708,380 | A | * | 1/1973 | Niebylski | 428/71 |
| 3,708,385 | A | * | 1/1973 | Immethun | 428/119 |
| 3,918,289 | A | * | 11/1975 | Oswald et al. | 72/439 |
| 4,315,962 | A | * | 2/1982 | Skoien | 428/12 |
| 4,677,798 | A | * | 7/1987 | Phillips | 52/106 |
| 5,118,555 | A | * | 6/1992 | Horovitz | 428/178 |
| 5,154,302 | A | | 10/1992 | Alcorn | |
| 5,206,067 | A | * | 4/1993 | Bonzo | 428/119 |
| 5,294,472 | A | * | 3/1994 | Arnold et al. | 428/120 |
| 5,372,868 | A | * | 12/1994 | Prewo et al. | 428/167 |
| 5,547,737 | A | * | 8/1996 | Evans et al. | 428/178 |
| 5,653,075 | A | * | 8/1997 | Williamson | 52/309.9 |
| 5,654,518 | A | * | 8/1997 | Dobbs | 89/36.02 |
| 5,768,851 | A | * | 6/1998 | Nagaoka | 52/790.1 |
| 5,914,175 | A | * | 6/1999 | Nudo et al. | 428/178 |
| 6,085,485 | A | * | 7/2000 | Murdock | 52/783.19 |
| 7,051,489 | B1 | * | 5/2006 | Swiszcz et al. | 52/783.18 |
| 7,562,508 | B2 | * | 7/2009 | Dickinson et al. | 52/793.1 |
| 7,998,299 | B2 | * | 8/2011 | McCarville et al. | 156/189 |
| 2002/0184850 | A1 | * | 12/2002 | Kamenomostski | 52/800.1 |
| 2003/0230038 | A1 | | 12/2003 | Seavy | |
| 2004/0074206 | A1 | * | 4/2004 | Tanase et al. | 52/783.17 |
| 2004/0107823 | A1 | * | 6/2004 | Kiley et al. | 86/50 |
| 2004/0134162 | A1 | * | 7/2004 | Douglas | 52/741.1 |
| 2004/0237465 | A1 | * | 12/2004 | Refond | 52/783.11 |
| 2005/0074587 | A1 | * | 4/2005 | Snel | 428/182 |
| 2005/0138891 | A1 | * | 6/2005 | Wool et al. | 52/782.1 |
| 2006/0112655 | A1 | * | 6/2006 | Swiszcz et al. | 52/222 |
| 2008/0163587 | A1 | * | 7/2008 | Monk et al. | 52/794.1 |
| 2008/0286552 | A1 | * | 11/2008 | Kordelin et al. | 428/223 |
| 2010/0080941 | A1 | * | 4/2010 | McCarville et al. | 428/34.1 |
| 2010/0294782 | A1 | | 11/2010 | Busch | |
| 2010/0320201 | A1 | | 12/2010 | Dagesse | |

FOREIGN PATENT DOCUMENTS

| | | | | |
|---|---|---|---|---|
| FR | 1 198 420 | A | | 12/1959 |
| FR | 1247006 | A | | 2/1961 |
| FR | 2280767 | A1 | | 2/1976 |
| GB | 1 207 617 | A | | 10/1970 |
| WO | 89/09859 | A1 | | 10/1989 |
| WO | WO 2008099052 | A1 | * | 8/2008 |

* cited by examiner

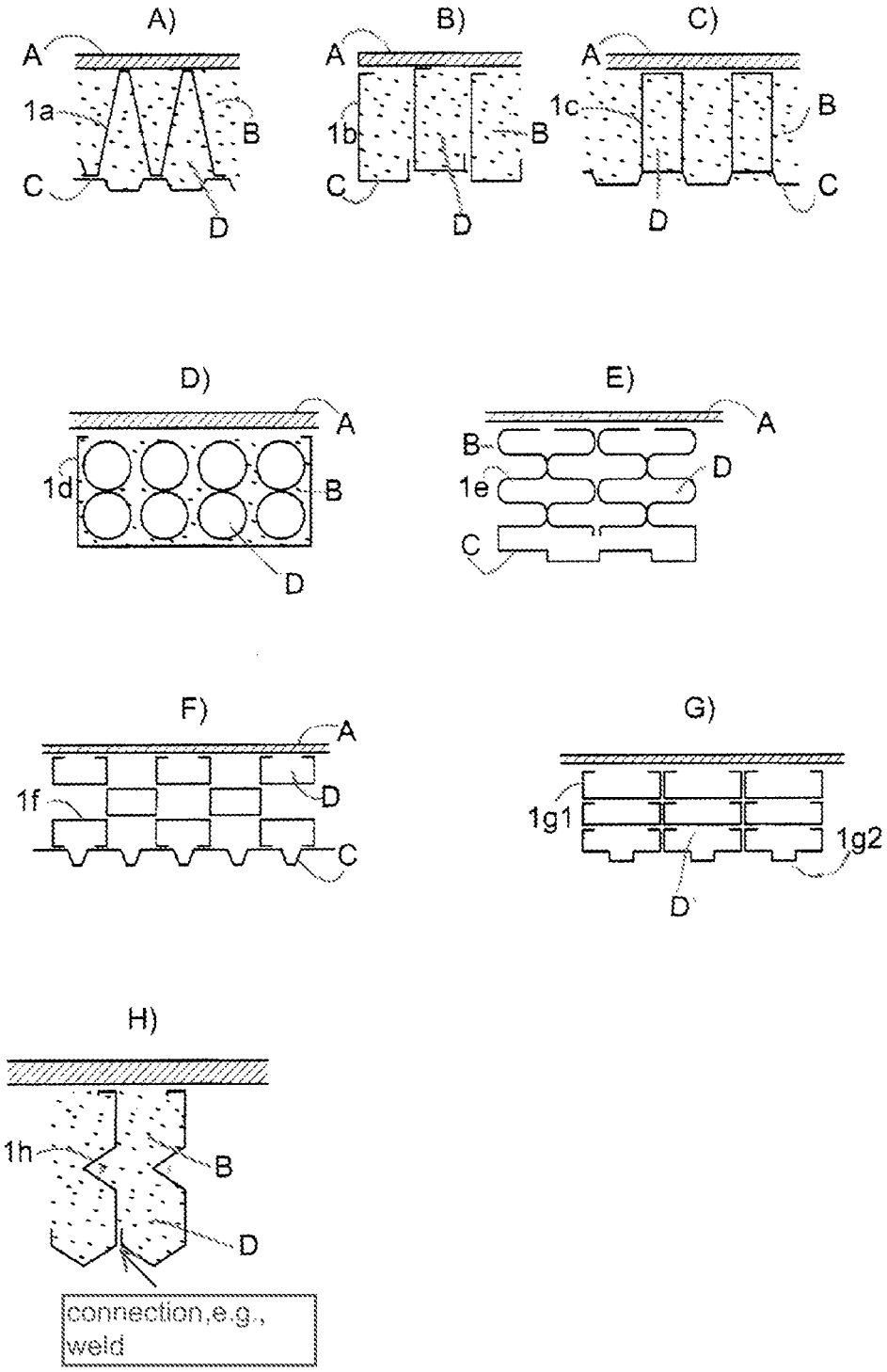
A)
A
1a
B
C
D
B)
A
1b
B
C
D
C)
A
1c
B
C
D
D)
A
1d
B
D
E)
A
B
D
1e
C
F)
A
1f
D
C
G)
1g1
1g2
D
H)
1h
B
D
connection,e.g., weld

METHOD OF PRODUCING AN ENFORCED DELIMITED ELEMENT AND SUCH AN ELEMENT

BACKGROUND OF THE INVENTION

The present invention relates to a method of producing an enforced composite surface delimitating element, such as a wall, floor or a ceiling preferably of a container, and an element manufactured according to said method.

DESCRIPTION OF THE RELATED ART

In all mechanical constructions there are a need of strength and durability. One must construct and build for the intended purpose and chose different materials in different shapes and constellations and understand how these interact to achieve the intended purpose. For several reasons it is important to choose materials and to shape these such that the final weight of the basic construction body can be kept low without loosing strength.

BRIEF SUMMARY OF THE INVENTION

One purpose of the present invention is to obtain an enforced composite surface delimitated element advantageously used in a container. Preferably the element are made up of several metallic profiles, which are connected into cell modules, which in turn are brought together to form surface delimitating elements.

In each cell module substance or material can be added according to need to give the construction element the properties needed such as insulation or properties withstanding burglar attacks.

The invention will be described in connection to a so called sea container, which is a container to be transported tight upon deck and upon each other onboard on container ships. More than eight containers are stacked upon each other and are internally locked and to the deck of the ship.

These stapled and tighten containers have to withstand impressive stresses during transportation over the oceans. A giant wave braking in over the side of a container ship will create tremendous stresses on both the tights and on the containers. It happens now and then that ships lose part of their container load when passing rough weather. Of course there are other circumstances where the present invention advantageously can be used. One such use is as mobile fuel depot where fuel is stored in one section of the container and the pump equipment is in an other section. Also here it is important to obtain a high degree of security, i.e. the enforced surface delimited elements will advantageously form the floor, the walls and the ceiling of the container.

The main purpose of the present invention is to obtain a method to manufacture a combined construction element forming part in e.g. a container, which element will withstand high dynamic stresses especially such stresses which can exist on an open sea and weather exposure placement and when tightening the containers upon each other on a ship deck.

An other object is to obtain a multi purpose construction element allowing the building of constructions with certain desired properties, such as shock proof and with a high resistance towards burglars.

Yet another purpose is to obtain a construction element using extruded cell modules of metal or of composite materials, which cell modules are internally connected.

The objects mentioned above will be obtained by a method and a construction element having the characterizing clauses mentioned in the claims.

By arranging the cell element with an essential depth extension and being internally connected, they will be very strong and withstand torsion stresses and outer stresses and thus protecting the container against deformation but also protecting the content of the container. It is of outmost importance that an outer stress or load onto the container will not cause any essential or long lasting deformation when carried on board upon deck. A deformation of the container will weaken the attachments to other containers and to the deck and can break the attachments to other containers or internally, i.e. the containers will be loosen and/or broken into pieces.

BRIEF DESCRIPTION OF THE DRAWINGS

The invention will now be described in connection to embodiments shown in the accompanying drawings, where;

FIG. 1A) is a section of a first element according to the invention,

FIG. 1B) is a section of a second element according to the invention,

FIG. 1C) is a section of a third element according the invention,

FIG. 1D) is a section of a fourth element according the invention,

FIG. 1E) is a section of a fifth element according the invention,

FIG. 1F) is a section of a sixth element according the invention,

FIG. 1G) is a section of a seventh element according the invention,

FIG. 1H) is a section of an element with an inner or outer surface cover.

DETAILED DESCRIPTION OF THE PREFERRED EMBODIMENTS

In FIG. 1A is shown a first embodiment where V shaped profile parts 1*a* have been connected and attached between an outer and an inner wall A and B resp. to form a surface delimited element D. In this embodiment the attachment between the profile parts 1*a* takes place via the wall C here in the form of an angled profiled sheet. The cell element D is formed between the profile parts.

In FIG. 1B L-formed profile parts 1*b* is shown being internally connected without the use of an inner wall, i.e. the profile parts are connected directly through welding. In this connection it shall be said that the L formed profile parts 1*b* have different heights and that elements D with higher heights are connected with an element having a lower height. In this way an angle profiled inner surface is obtained.

In FIG. 1C is shown how U-shaped profile parts 1*c* are connected and attached between an outer and an inner wall A and B respectively. Here the profile parts 1*c* are not interconnected but are attached only to the outer and inner walls and forming a space between them constituting the cell element D.

In FIG. 1D an example of an extruded profile part 1*d* is shown which part having eight channels/openings surrounded of a homogenous material. These channels/openings are forming the cell element D. Several profile parts 1*d* are connected to form a profile element of a desired size.

By extruding the profile part 1*d* of aluminium light construction, elements are created the completing properties of which to a great extend depend on the materials being filled into the cell elements.

In FIG. 1E profile parts 1*e* with a double S-shape are shown and which are connected both internally and between an outer and an inner wall. The internal connection can be by welding. This construction will give a very strong and resilient construction element by itself, i.e. without filling the cell element. If these cell elements D are filled with an expanded material both strength and insulation properties are enhanced.

In FIG. 1F are shown outer and inner U shaped profile parts 1*f* being connected using interlaying hollow joist elements D having a rectangular cross section. From this cell modules with different cell elements are made where the interconnected joist elements D at the same time forming distance means. It can be noticed here that the outer and the inner profile parts 1*f* are shown directed towards opposite directions, i.e. with their openings outwards and inwards respectively. The internal connection can also here take place by welding.

In FIG. 1G two types of profile parts $\mathbf{1}g_1$ and $\mathbf{1}g_2$ are shown where the outer profile parts $\mathbf{1}g_1$ are attached to a plate and where the inner profile parts $\mathbf{1}g_2$ at the same time having an outer angle iron in such a way that the surface will not be smooth.

In FIG. 1H profile parts 1*h* having a bent cross section which has been connected both internally and against a wall. The cell elements being formed hereby will also have a bent cross section. This embodiment will give a bigger adjacent surface between the cell elements. The internal connection will take place by welding. In this shape of the construction the cell elements are created by the angle profiles of metal which also may act as enforcement in the case the cell elements are filled with concrete.

Thus in the above different embodiments of cell elements are shown and created which in one hand can be empty or filled with cellular plastic materials, leca, super hard ceramic balls, expanded polyurethane, rock wool, glass wool, concrete, fibre concrete, foamed concrete or foamed aluminium. The walls can be plates of gypsum, plywood, steel plates (profiled or smooth), sheets of aluminium or wooden plates. In all the above described embodiments the inside and the outside can alter positions. When there is a need to have a smooth outside this will be possible according to the invention without loosing the properties of the enforced surface delimited element.

The invention shall not be restricted to the above shown embodiments but modifications may be done within the scope of the following claims.

The invention claimed is:

1. A method of producing an enforced composite surface delimited element, comprising the steps of:

forming connected cell modules by connecting metal profile elements side by side to each other and to an inner side of an outer wall layer, the profile elements having a length within the interval 200-250 cm, a width within the interval 15-35 cm, and a depth within the interval 18-40 cm, and the cell modules having passing through cell elements, wherein said metal profile elements each have a bent cross section, each bent cross section comprising a first distal end connected to a first straight section, the first straight section extending away from the inner side of the outer wall layer and being connected to a V-shape section, the V-shaped section extending away from the inner side of the outer wall layer and being connected to another straight section, the another straight section extending away from the inner side of the outer wall layer and being connected to a second distal end of the bent cross section, with i) the first distal end of each bent cross section being connected against the inner side of the outer wall layer, ii) the second distal end of each bent cross section being located adjacent each other and thereby together defining an exposed inner wall layer of the surface delimited element, and iii) a distal-most end portion of the second distal end of the bent cross section a) extends from the exposed inner wall layer towards the inner side of the outer wall layer and b) is internally connected to the another straight section of the bent cross section of an adjacent-most metal profile element; and filling said cell modules by adding a material between said inner and outer wall layers to add insulation properties to said thus-form surface delimited element.

2. The method of claim 1, wherein the produced enforced composite surface delimited element is one of the group consisting of a wall of a container, a ceiling of a container, and a roof of a container, and the bent cross sections are internally connected to each other by welding.

3. The method of claim 2, wherein the material filling said cell modules is concrete.

4. The method of claim 1, wherein the material filling said cell modules is concrete.

5. The method of claim 1, wherein the material filling said cell modules is expanded polyurethane.

6. The method of claim 1, wherein the material filling said cell modules is foamed concrete.

7. The method of claim 1, wherein the material filling said cell modules is foamed aluminium.

8. The method of claim 1, wherein the material filling said cell modules is one of the group consisting of cellular plastic materials, leca, ceramic balls, rock wool, and glass wool.

9. An enforced composite surface delimited element, comprising:

an outer wall layer;

an inner wall layer; and cell modules defined by metal profile elements connected side by side to each other, wherein the profile elements have a length within the interval 200-250 cm, a width within the interval 15-35 cm, and a depth within the interval 18-40 cm, wherein the cell modules have passing through cell elements, wherein said metal profile elements each have a bent cross section, each bent cross section comprising a first distal end connected to a first straight section, the first straight section extending away from the inner side of the outer wall layer and being connected to a V-shape section, the V-shaped section extending away from the inner side of the outer wall layer and being connected to another straight section, the another straight section extending away from the inner side of the outer wall layer and being connected to a second distal end of the bent cross section, with i) the first distal end of each bent cross section connected against an inner side of said outer wall layer, ii) the second distal end of each bent cross section being located adjacent each other and thereby defining the inner wall layer, and iii) a distal-most end portion of the second distal end of the bent cross section a) extends from the exposed inner wall layer towards the inner side of the outer wall layer and b) is internally connected to the another straight section of the bent cross section of an adjacent-most metal profile element; and said cell modules are filled with a material between said inner and outer wall layers, said material adding an insulation property to said surface delimited element.

10. The element of claim 9, wherein the bent cross sections are internally connected to each other by welds.

11. The element of claim 9, wherein the material filling said cell modules is concrete.

12. The element of claim 9, wherein the material filling said cell modules is expanded polyurethane.

13. The element of claim 9, wherein the material filling said cell modules is foamed concrete.

14. The element of claim 10, wherein the material filling said cell modules is foamed aluminium.

15. The element of claim 9, wherein the material filling said cell modules is one of the group consisting of cellular plastic materials, leca, ceramic balls, rock wool, and glass wool.

* * * * *